US008783141B2

(12) United States Patent
Caswell

(10) Patent No.: US 8,783,141 B2
(45) Date of Patent: Jul. 22, 2014

(54) FOLDING KNIFE WITH NON-SNAGGING AUTOMATIC POCKET CLIP

(76) Inventor: Joseph Caswell, Newbury Park, CA (US)

( * ) Notice: Subject to any disclaimer, the term of this patent is extended or adjusted under 35 U.S.C. 154(b) by 0 days.

(21) Appl. No.: 13/199,109

(22) Filed: Aug. 19, 2011

(65) Prior Publication Data

US 2012/0000077 A1 Jan. 5, 2012

Related U.S. Application Data

(63) Continuation-in-part of application No. 11/466,340, filed on Aug. 22, 2006, now Pat. No. 8,112,894.

(60) Provisional application No. 61/402,688, filed on Sep. 1, 2010.

(51) Int. Cl.

| | |
|---|---|
| ***B26B 3/06*** | (2006.01) |
| ***A45F 5/02*** | (2006.01) |
| ***B26B 1/02*** | (2006.01) |
| ***B26B 11/00*** | (2006.01) |

(52) U.S. Cl.

CPC ... *A45F 5/02* (2013.01); *B26B 1/02* (2013.01); *A45F 2200/0591* (2013.01); *B26B 11/00* (2013.01); *A45F 5/022* (2013.01)

USPC ..... 83/13; 30/151; 30/155; 24/3.11; 24/3.1; 224/269

(58) Field of Classification Search

CPC ..... B26B 1/00; B26B 1/02; B26B 1/04; B26B 1/042; B26B 1/044; A45F 5/00; A45F 5/004; A45F 5/02; A45F 5/021; A45F 5/022

USPC ..... 30/151–164; 224/269, 929, 930; 24/3.1, 24/3.11, 3.12, 11 R; 7/118–120; 83/13

See application file for complete search history.

(56) References Cited

U.S. PATENT DOCUMENTS

| | | | | |
|---|---|---|---|---|
| 2,896,290 | A | 7/1959 | Salm et al. | |
| 4,570,341 | A * | 2/1986 | Konneker | 30/161 |
| 4,622,744 | A * | 11/1986 | Nogueira | 30/155 |
| 4,773,159 | A | 9/1988 | Casazza, Jr. | |
| 5,038,985 | A | 8/1991 | Chapin | |
| 6,112,352 | A * | 9/2000 | Legg | 7/158 |
| D487,628 | S | 3/2004 | Mathews | |
| 6,941,604 | B2 | 9/2005 | Ackeret | |
| 7,451,545 | B2 | 11/2008 | Voros | |
| 2002/0153395 | A1 | 10/2002 | Martinez | |
| 2004/0129746 | A1 | 7/2004 | Lee et al. | |
| 2006/0113985 | A1 | 6/2006 | Gist et al. | |
| 2007/0289141 | A1 * | 12/2007 | Caswell | 30/160 |

* cited by examiner

*Primary Examiner* — Phong Nguyen

(57) ABSTRACT

A folding knife with retractable pocket clip that moves in an arc between retracted and deployed positions generally within the same pivot plane as a pivotally folding blade and whose movement between retracted and deployed positions is coordinated through direct contact with the blade so that the clip is automatically deployed for use as the blade is pivoted into a storage position and automatically retracted when the blade is pivoted to a position for use. The pocket clip is configured to be uniquely sheltered from snagging hazards and to secure the folding knife to a pocket by means of a unique retentive characteristic resulting from localized tension advantageously generated along the pocket edge and maintained by compression exerted upon the body of the knife as it rests within the pocket.

2 Claims, 4 Drawing Sheets

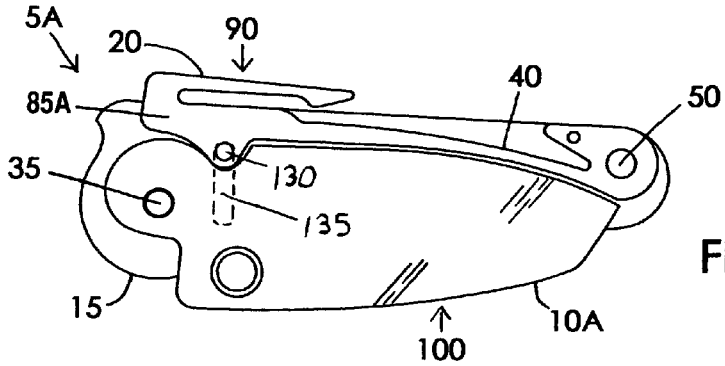
FIG. 2A
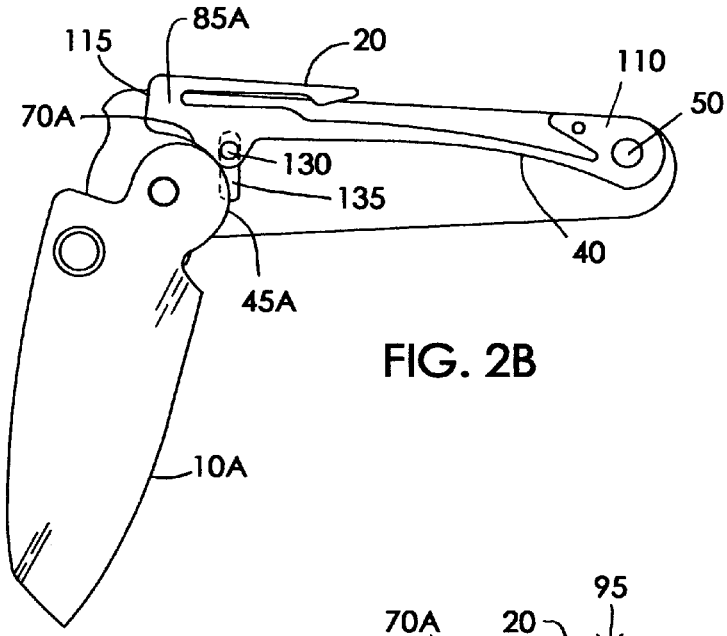
FIG. 2B
FIG. 2C
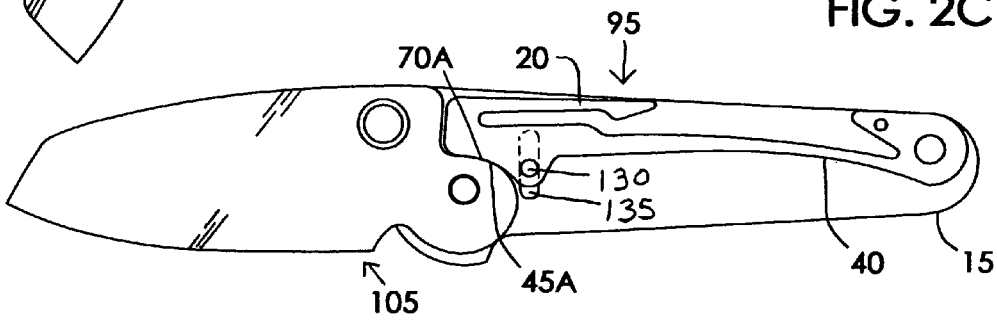

FOLDING KNIFE WITH NON-SNAGGING AUTOMATIC POCKET CLIP

CROSS-REFERENCE TO RELATED APPLICATIONS

This application is a Continuation-In-Part of application Ser. No. 11/466,340 filed Aug. 22, 2006, now U.S. Pat. No. 8,112,894.

This application claims the benefit of U.S. Provisional Patent Application 61/402,688 filed on Sep. 1, 2010.

STATEMENT REGARDING GOVERNMENT SPONSORED RESEARCH AND DEVELOPMENT

Not Applicable.

FIELD OF INVENTION

This invention relates to pocket knives, and more particularly, to a novel non-snagging, automatically deploying and retracting pocket clip for such a knife.

Background

Clips for retaining a pocket knife onto a pair of pants or pants pocket are known in the art. Generally, such clips are elongated and protrude conspicuously from one side of the object, being rigidly fixed thereto. In the case of a pocket knife, U.S. Design Pat. No. 487,628 exemplifies such a clip. While such a clip does help retain a knife onto an object, such as a pants pocket, it is obtrusive and can snag on items undesirably while deployed in a pocket in the conventional manner; with pocket knife on the inside of the pocket and clip on the outside of the pocket. Such snagging can result in damage to the clip, the pocket and/or the snagged object.

The presence of a pocket clip on the side of a knife results in discomfort as the tool is gripped in the hand. Furthermore, the presence of such a clip can be aesthetically objectionable, which is an especially important consideration in the field of folding knives wherein the details of form and style are very important to the commercial success of the product.

To overcome these drawbacks retractable clips have been devised. For example, US Patent Application 2002/0153395 to Martinez on Oct. 24, 2002 teaches a belt clip that pivots away from the body of the knife, generally perpendicular to the pivot plane of the blade. U.S. Pat. No. 6,941,604 to Ackeret, on Sep. 13, 2005 teaches a similar retracting clip. One of the fundamental deficiencies of clips so configured is that the space between the clip and the knife necessarily decreases in depth toward the pivot point of the clip. As fabric or other object is moved toward the pivot point, the open-end portion of the clip is forced further from the body of the assembly, the clip invariably protruding at an increasingly pronounced angle away from the assembly, becoming more of an encumbrance than convenience. Also, such clips do not tend to retain the knife to objects well, since such clips necessarily bind the object toward their pivot point specifically and not their distal ends. As a result, the object is pinched only in a small area, and as such, the knife can easily become dislodged if jolted.

US Patent Application 2004/0129746 to Lee et al. on Jul. 8, 2004, and US Patent Application 2006/0113985A to Gist et al. on Jun. 1, 2006, both teach belt clips for objects in one case a phone and in the other case an electronic hand tool. These clips overcome some of the disadvantages mentioned heretofore, but still dispose the clip itself to snagging and damage if deployed in a pocket in such a way that the tool is inside the pocket and the clip outside, which is the traditional method of carrying knives equipped with pocket clips.

Additional to the aforementioned deficiencies, the cited retractable pocket clips are deployed by an exclusive manual action, the practice of which constitutes an inconvenient prerequisite to the act of securely storing a pocket knife into the pocket.

U.S. Pat. No. 7,451,545 to Voros teaches a retractable pocket clip that is coordinated with the movement of the blade to and from an extended position by means of an actuating linkage between the blade and clip. The disclosed "actuating assembly" involves complication and requires substantial space to one side of the blade in order to contain, necessarily resulting in a an undesirably thick folding knife assembly. There are also several sliding friction surfaces moving within multiple planes necessary to the actuation and guidance of the clip along its rectilinear travel, which is particularly undesirable in a tool that is likely to be fouled with foreign matter during regular use. Furthermore, while either extended or retracted, the presence of such a clip is aesthetically conspicuous which is an important consideration in the field of folding knives wherein the details of form and style are very important to the commercial success of a product.

Additionally, like other references mentioned heretofore, the clip is disposed to snagging on objects resulting in damage to such objects and to itself when deployed within a pocket in the aforementioned traditional manner. That is because, when so deployed in a pants pocket, the clip extends outwardly generally perpendicular to the mean exterior surface of the pocket. The clip becomes more prominent still, being necessarily situated directly atop the bulge that is created by the knife when carried in the pants pocket. It is therefore uniquely exposed to snagging hazards and damage during the course of regular deployment within a pants pocket.

SUMMARY

In accordance with the present invention, all the above-stated problems are solved by providing a folding knife with a retractable pocket clip that moves substantially in an arc between retracted and deployed positions generally within the same pivot plane as a pivotally folding blade and whose movement between retracted and deployed positions is coordinated through direct contact with the blade so that the clip is automatically deployed for use as the blade is pivoted into it's storage position and automatically retracted when the blade is pivoted to a position for use; the pocket clip thereby uniquely disappearing completely within the outer periphery of the knife assembly in the retracted position and extending beyond the outer periphery of the knife assembly in the deployed position generally within the same pivot plane as the blade.

At the heart of the present invention, is applicant's discovery that a pocket clip extending generally within the aforementioned plane is uniquely sheltered from snagging hazards while the knife, so equipped, is worn as customary; with knife in the pocket and clip outside the pocket. With the knife so deployed in the pocket, the clip is substantially below the mean exterior surface of the pocket due to its position relative to the bulge necessarily created by the knife in the pocket. This constitutes a counterintuitive advancement in the art of pocket clips for folding knives.

Additionally applicant has discovered and herein discloses a unique and unexpected retentive tendency provided by a clip so configured. In contrast with conventional pocket clips, which bind a knife to a pants pocket edge by pinching spring tension, the knife of the present invention enjoys a retentive tendency generated between the clip and knife as the pocket edge is caused to bend or kink once around the knife and again as it passes under the clip. As a result, localized tension is advantageously generated along the pocket edge and maintained by compression exerted upon the body of the knife as it rests within the pocket.

DESCRIPTION OF DRAWINGS

The foregoing, as well as other objects of the present invention, will be further apparent from the following detailed description of the preferred embodiment of the invention, when taken together with the accompanying specification and drawings in which:

FIG. 2A to 2C show the first embodiment wherein clip movement is facilitated by flexure, and the interrelationship between blade and clip at different positions of blade rotation are seen.

DETAILED DESCRIPTION

Figure 1A:
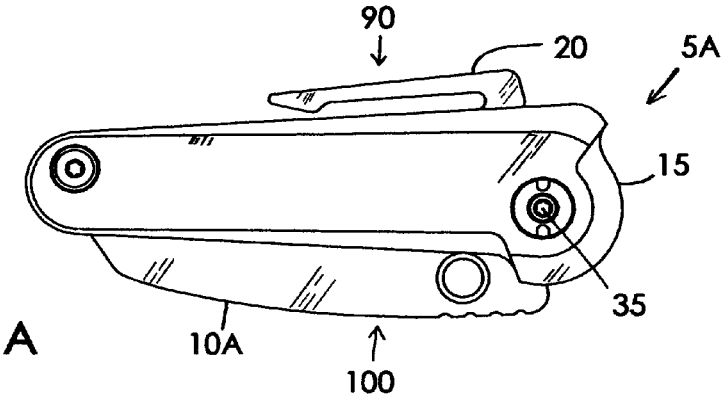
FIG. 1A shows a view of the current invention in such condition that the blade is in its storage position and clip consequently deployed for use.
Figure 1B:
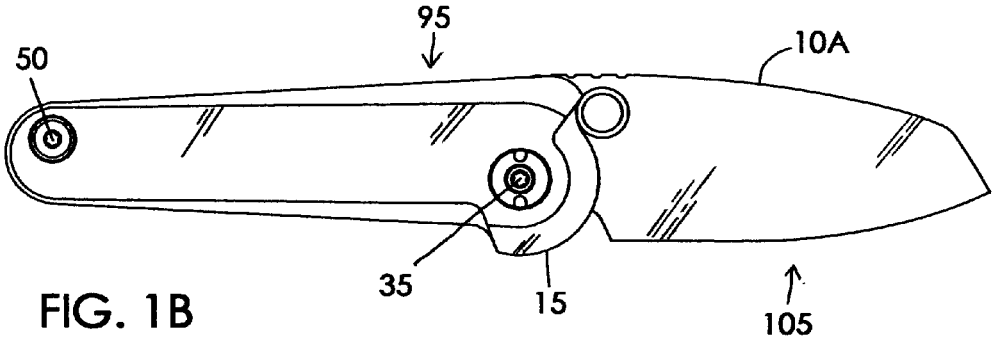
FIG. 1B shows a view of the current invention in such condition that the blade is in its position for use and clip consequently retracted.
Figure 1C:
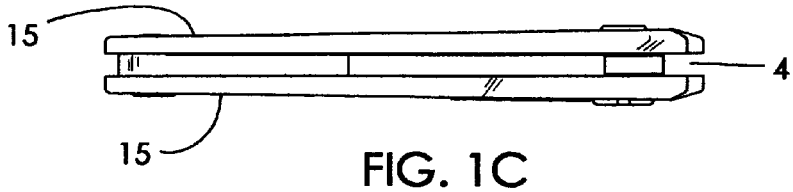
FIG. 1C shows a top plan view of the current invention in such condition that the blade is in its storage position.

FIGS. 1A to 1C illustrate a folding knife 5A (FIG. 1A) comprising two rigid members 15 spaced generally parallel to each other thereby forming a channel 4 (FIG. 1C). A pivot 35 (FIG. 1A, 1B) is provided that permits the blade 10A to pivot between a storage position 100 (FIG. 1A) and a position for use 105 (FIG. 1B) within a pivot plane and about a pivot axis 6 (FIG. 4), the pivot plane being generally perpendicular to pivot axis 6.

It is to be understood that, as used herein, "blade" can refer to a number of items, including a tool, implement, cutting blade, or a holder for such tool, implement or cutting blade, and is not to be limited to the blade depicted in the Figures.

The clip 85A (FIG. 2B) of the first embodiment is not readily detachable, being rigidly fixed from an attachment end 110 to at least one rigid member 15 (FIGS. 2A, 2C). In this embodiment, this is accomplished by a fastener 50 which may alternatively be substituted for other attachment means.

Clip 85A includes a flexure portion 40. In this embodiment, flexure portion 40 is located generally intermediate clip 85A between attachment end 110 and moving end 115 (FIG. 2B) and allows moving end 115 to move substantially in an arc relative to attachment end 110 and substantially within the pivot plane of blade 10A.

Clip 85A further includes an elongated free end 20 near moving end 115 (FIGS. 2A to 2C). Elongated free end 20 is configured to define a space wherein fabric or other material may be inserted.

Figure 4:
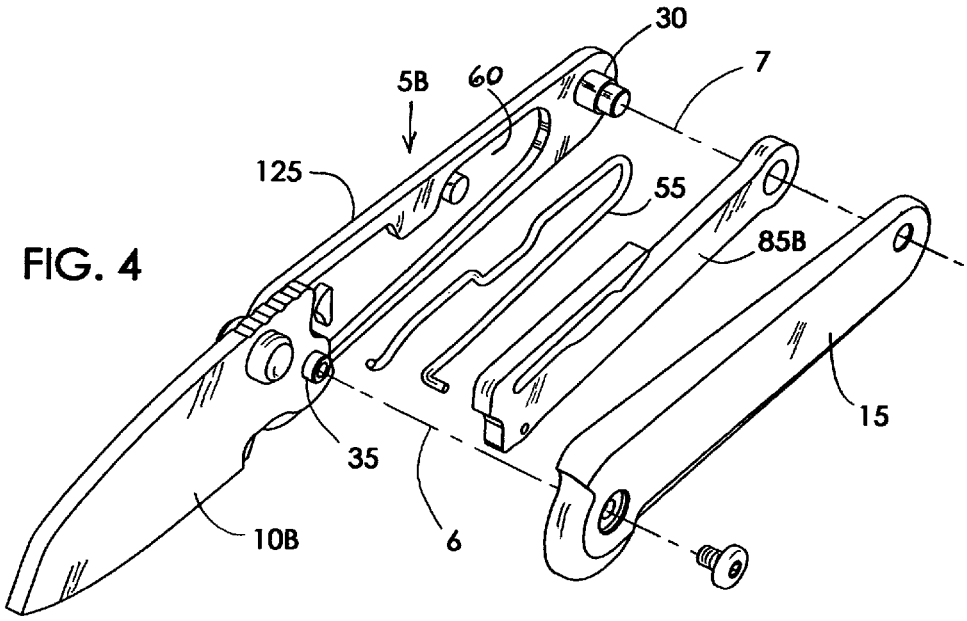
FIG. 4 shows an exploded view of the second embodiment wherein clip movement is facilitated by fixed pivot, and further showing biasing member and corresponding recess in rigid member. Also shown are certain elements common to both first and second embodiments.

FIGS. 2B and 2C further show that moving end 115 of clip 85A features a blade-engagement surface 70A, the purpose of which is made clear in light of its interaction with pivoting blade 10A that includes a tang having a clip-engagement surface 45A (FIGS. 2B, 2C) that extends generally radially outwardly with respect to pivot axis 6 (FIG. 4). Because of this, clip-engagement surface 45A necessarily displaces clip 85A as blade 10A is moved to storage position 100 (FIG. 2A) by direct interaction with blade-engagement surface 70A of clip 85A (FIGS. 2B, 2C). The result is that elongated free end 20 is projected beyond the outer periphery of rigid members 15 and therefore made available for use, having reached deployed position 90 (FIG. 2A).

FIGS. 2A to 2C further show that extension of clip 85A beyond deployed position 90 is prevented by a boss 130 which projects from clip 85A, generally perpendicular to the pivot plane. Boss 130 moves within a corresponding slot 135 in at least one rigid member 15 until it collides with the end of slot 135, preventing further movement in that direction.

FIGS. 2A to 2C further depict flexure portion 40 as configured to provide constant urging force by spring tension to bias moving end 115 of clip 85A against clip-engagement surface 45A of blade 10A. This ensures that as blade 10A is pivoted to position for use 105 (FIG. 2C), clip 85A moves progressively to retracted position 95. That is because, relative to blade-engagement surface 70A of clip 85A, clip-engagement surface 45A of blade 10A recedes generally inwardly with respect to pivot axis 6 as blade 10A is pivoted toward position for use 105.

In use, clip 85A automatically moves between retracted position 95 and deployed position 90 generally within the same pivot plane as pivotally folding blade 10A (FIGS. 1A to 1C, 2A to 2C). This movement between retracted position 95 and deployed position 90 (FIGS. 2A, 2C) is coordinated with the movement of blade 10A by direct interaction between blade 10A and clip 85A. As a result, elongated free end 20 is automatically deployed for use as blade 10A is pivoted into storage position 100 and automatically retracted to a point substantially contained between the two rigid members 15 of knife 5A when blade 10A is pivoted to position for use 105.

Figure 5:
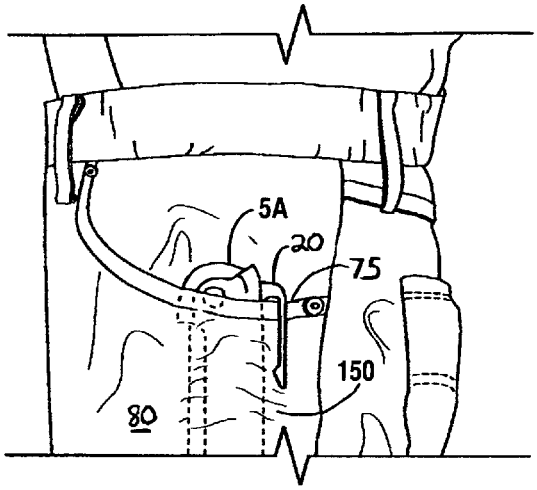
FIG. 5 shows a left-side elevational view of a person carrying the knife of the present invention in a pocket, the clip member in the extended position and engaged in the pocket

As shown in FIG. 5, when clip 85A is in deployed position 90 (FIG. 2A), and an object, such as a pants pocket edge 75, for example, is positioned between elongated free end 20 and knife 5A, knife 5A is retained to the pocket 80 by friction generated from tension. More specifically, a unique retentive tendency is produced between elongated free end 20 and knife 5A. That is because pocket edge 75 is caused to bend once around knife 5A and again as it passes under elongated free end 20 (FIG. 5). Localized tension is advantageously generated along pocket edge 75 between elongated free end 20 and knife 5A and maintained as knife 5A is held flat in pocket 80 by compression generated between pocket 80 and the body of the user as parts are worn. With knife 5A so positioned in pocket 80, such compression from pocket 80 is directed generally perpendicular to the pivot plane of blade 10A and is the natural result of the presence of knife 5A within pocket 80.

With knife 5A so deployed in pocket 80, free end 20 is sheltered from snagging and abrasion by the bulge 150 created by knife 5A in pocket 80 while knife 5A is worn as show in FIG. 5. Free end 20 is recessed below the mean outer surface of pocket 80 relative to bulge 150 and is consequently substantially less likely to cause damage to objects that come into contact with the mean outer surface of pocket 80 and bulge 150 while knife 5A is worn in pants pocket 80, nor is it so readily inclined to snag disadvantageously upon such objects.

Alternatively, clip 85A may be configured to remain in deployed position 90 (FIG. 2A). This may be accomplished by biasing flexure 40 to constantly urge clip 85A toward deployed position 90. If desired, clip 85A may be locked into deployed position 90 by replacing slot 135 in rigid member 15 with a hole (not shown) into which boss 130 may fit and that is positioned concentric with boss 130 while clip 85A is in deployed position 90, thus constraining movement of moving end 115.

Figure 3A:
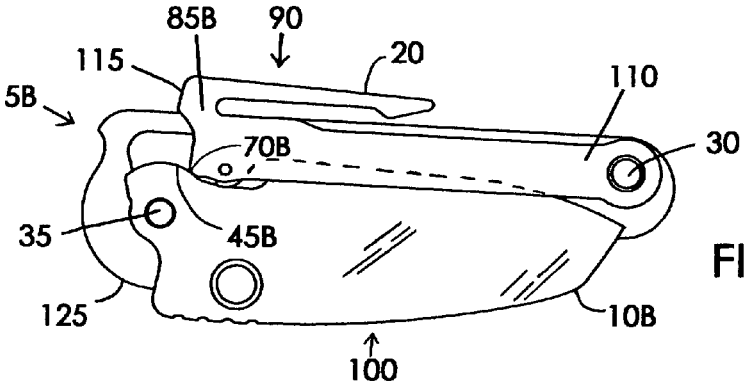
FIG. 3A to 3C show a second embodiment wherein clip movement is facilitated by fixed pivot and the interrelationship between blade and clip at different positions of blade rotation are seen.
Figure 3B:
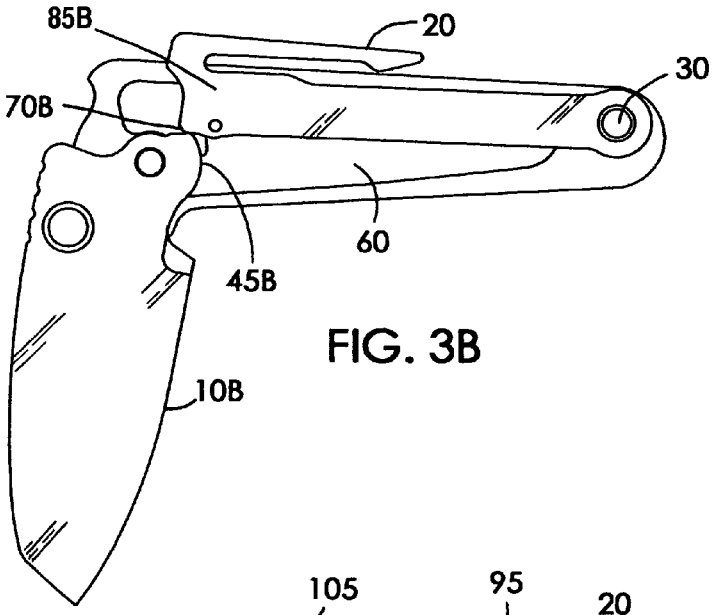
Figure 3C:
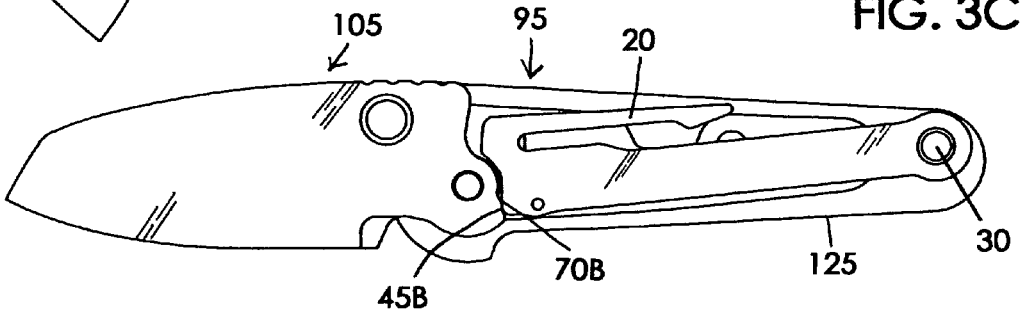

A second embodiment of the present invention, alternate knife 5B, is shown in FIGS. 3A to 3C, and in FIG. 4. In this embodiment, alternate clip 85B is pivotally connected from attachment end 110 to alternate rigid member 125 by means of a rear pivot 30 which permits alternate clip 85B to pivot between deployed position 90 and retracted position 95 within a pivot plane and about a rear pivot axis 7 (FIG. 4) which is substantially parallel with pivot axis 6 and substantially perpendicular to the pivot plane. Consequently, alternate clip 85B moves substantially within the same pivot plane as alternate blade 10B and in an arc relative to attachment end 110 (FIG. 3A). It is not configured to be readily detachable from alternate rigid member 125.

Alternate clip 85B (FIG. 3A) is continually urged directly against alternate clip engagement surface 45B of alternate blade 10B, which extends generally radially outwardly with respect to pivot axis 6 (FIG. 4), by means of a biasing member 55 (FIG. 4). Biasing member 55 is configured to fit into a recess 60 in alternate rigid member 125 (FIG. 4) and to urge alternative clip 85B toward retracted position 95 by spring tension so that free end 115 of alternative clip 85B is continually biased directly against alternate clip engagement surface 45B of alternate blade 10B.

In use, elongated free end 20 is moved to deployed position 90 as alternate blade 10B is moved to storage position 100 (FIG. 3A). Conversely, as alternate blade 10B is moved to position for use 105 (FIG. 3C), alternate clip 85B, being constantly urged against alternate clip engagement surface 45B by biasing member 55, moves to retracted position 95 as clip engagement surface 45B recedes generally inwardly with respect to pivot axis 6.

As shown in FIGS. 3A to 3C, blade engagement surface 70B may be configured to interact with alternate clip engagement surface 45B in a manner that alternate clip 85B will selectively impede pivoting movement of alternate blade 10B from position for use 105 toward storage position 100 while alternate clip 85B is in retracted position 95.

While embodiments of the present invention have been illustrated and described using specific terms, such description is for present illustrative purposes only and it is to be understood that changes and variations to such embodiments, including but not limited to the substitution of equivalent features of parts and the reversal of various features thereof, may be practiced by those of ordinary skill in the art without departing from the spirit or scope of the following claims.

What is claimed is:

1. A method for safely attaching a folding pocket knife to the edge of a pant pocket comprising:

a. providing a pocket knife having a rigid member with first and second longitudinal sides and first and second lateral sides and a blade that moves within a plane between a position of storage extending generally adjacent said rigid member and a position for use extending away from said first lateral side; said pocket knife having an elongated pocket clip configured to move substantially within said plane between a retracted position generally adjacent said second lateral side of said rigid member and substantially within the outer periphery of said rigid member, and an extended positions spaced away from said second lateral side so as to provide space between said elongated pocket clip and said outer periphery of said rigid member, b. impelling said elongated pocket clip toward said extended position, c. providing a pant with pocket, said pocket having a pocket edge that is substantially parallel to said pant defining a pocket opening, d. placing said pocket edge of said pant pocket into said space between said elongated pocket clip and said rigid member and inserting said folding pocket knife into said pant pocket so that said plane is substantially perpendicular to said pocket edge, e. turning said folding pocket knife within said pocket until said plane is substantially parallel with said pocket edge, said elongated pocket clip inducing a portion of said pocket edge within said space to kink in a direction generally perpendicular to said plane thereby generating retentive tension between said pocket edge, said elongated pocket clip and said rigid member, f. wearing said pant thereby maintaining compression upon said folding pocket knife within said pocket, said compression preventing said folding pocket knife from turning within said pocket in such a way as to relieve said retentive tension along said pocket edge.

2. A method for safely attaching a folding pocket knife to the edge of a pant pocket comprising:

a. providing a pocket knife having a rigid member with first and second longitudinal sides and first and second lateral sides and a blade that moves within a plane between a position of storage extending generally adjacent said rigid member and a position for use extending away from said first lateral side; said pocket knife having an elongated pocket clip configured to move substantially within said plane between a retracted position generally adjacent said second lateral side of said rigid member and substantially within the outer periphery of said rigid member, and an extended positions spaced away from said second lateral side so as to provide space between said elongated pocket clip and said outer periphery of said rigid member, said elongated pocket clip of said pocket knife being configured to automatically contact said blade, that upon moving of said blade to said position for storage, said elongated pocket clip is simultaneously automatically impelled toward said extended position, b. impelling said elongated pocket clip toward said extended position, c. providing a pant with pocket, said pocket having a pocket edge that is substantially parallel to said pant defining a pocket opening, d. placing said pocket edge of said pant pocket into said space between said elongated pocket clip and said rigid member and inserting said folding pocket knife into said pant pocket so that said plane is substantially perpendicular to said pocket edge, e. turning said folding pocket knife within said pocket until said plane is substantially parallel with said pocket edge, said elongated pocket clip inducing a portion of said pocket edge within said space to kink in a direction generally perpendicular to said plane thereby generating retentive tension between said pocket edge, said elongated pocket clip and said rigid member, f. wearing said pant thereby maintaining compression upon said folding pocket knife within said pocket, said compression preventing said folding pocket knife from turning within said pocket in such a way as to relieve said retentive tension along said pocket edge.

* * * * *